US006441680B1

(12) United States Patent
Leung et al.

(10) Patent No.: US 6,441,680 B1
(45) Date of Patent: Aug. 27, 2002

(54) CMOS VOLTAGE REFERENCE

(75) Inventors: Ka Nang Leung; Kwok Tai Philip Mok; Ka Chun Kwok, all of Kowloon (HK)

(73) Assignee: The Hong Kong University of Science and Technology, Hong Kong (HK)

( * ) Notice: Subject to any disclaimer, the term of this patent is extended or adjusted under 35 U.S.C. 154(b) by 0 days.

(21) Appl. No.: 09/819,801

(22) Filed: Mar. 29, 2001

(51) Int. Cl.[7] ..... G05F 1/10
(52) U.S. Cl. ..... 327/541
(58) Field of Search ..... 327/530, 534, 327/535, 537, 538, 539, 540, 541

(56) References Cited

U.S. PATENT DOCUMENTS

| | | | | |
|---|---|---|---|---|
| 5,434,534 A | | 7/1995 | Lucas | 327/546 |
| 5,982,201 A | * | 11/1999 | Brokaw et al. | 323/312 |
| 6,040,735 A | * | 3/2000 | Park et al. | 323/313 |
| 6,236,249 B1 | * | 5/2001 | Choi et al. | 327/143 |
| 6,316,990 B1 | * | 11/2001 | Tanizawa | 323/312 |

OTHER PUBLICATIONS

Annema, Anne–Johan, "Low–Power Bandgap References Featuring DTMOST's", IEEE Journal of Solid–State Circuits, vol. 34, No. 7, Jul. 1999, pp. 949–955.
Banba, Hironori et al, "A CMOS Bandgap Reference Circuit with Sup–1–V Operation", IEEE Journal of Solid–State Circuits, vol. 34, No. 5, May 1999, pp 670–674.
Blauschild, Robert A., "A new NMOS Temperature–Stable Voltage Reference", IEEE Journal of Solid–State Circuits, vol. SC–13, No. 6, Dec. 1978, pp. 767–774.
Gunawan, Made et al, "A Curvature–Corrected Low–Voltage Bandgap Reference", IEEE Journal of Solid–State Circuits, vol. 28, No. 6, Jun. 1993, pp. 667–670.
Lee, Inyeol et al, "Exponential Curvature–Compensated BiCMOS Bandgap References", IEEE Journal of Solid–State Circuits, vol. 29, No. 11, Nov. 1994, pp. 1396–1403.
Meijer, Gerard C.M. et al, "A New Curvature–Corrected Bandgap Reference", IEEE Journal of Solid–State Circuits, vol. SC–17, No. 6, Dec. 1982, pp. 1139–1143.
Miller, Perry et al, "Precision Voltage References", Texas Instruments Incorporated, Analog Applications Journal, Analog and Mixed–Signal Products, Nov. 1999, pp. 1–4.
Rincon–Mora, Gabrial A. et al, "A 1.1–V Current–Mode and Piecewise–Linear Curvature–Corrected Bandgap Reference", IEEE Journal of Solid–State Circuits, vol. 33, No. 10, Oct. 1998, pp. 1551–1554.
Song, Bang–Sup et al, "A Precision Curvature–Compensated CMOS Bandgap Reference", IEEE Journal of Solid–State Circuits, vol. SC–18, No. 6, Dec. 1983, pp. 634–643.
Song, Ho–Jun et al, "A Temperature–Stabilized SOI Voltage Reference Based on Threshold Voltage Difference Between Enhancement and Depletion NMOSFET's", IEEE Journal of Solid–State Circuits, vol. 28, No. 6, Jun. 1993, pp. 671–677.
Tsividis, Yannis P., "A CMOS Voltage Reference", IEEE Journal of Solid–State Circuits, vol. SC–13, No. 6, Dec. 1978, pp. 774–778.
Tzanateas, C. et al, "A CMOS Bandgap Voltage Reference", IEEE Journal of Solid–State Circuits, vol. SC–14, No. 3, Jun. 1979, pp. 655–657.
Vittoz, Eric, "CMOS Analog Integrated Circuits Based on Weak Inversion Operation", IEEE Journal of Solid–State Circuits, vol. SC–12, No. 3, Jun. 1977, pp. 224–231.
Widlar, Robert J., "New Developments in IC Voltage Regulators", IEEE Journal of Solid–State Circuits, vol. SC–6, No. 1, Feb. 1971, pp. 2–7.

* cited by examiner

*Primary Examiner*—Jeffrey Zweizig
(74) *Attorney, Agent, or Firm*—Burns, Doane, Swecker & Mathis, L.L.P.

(57) ABSTRACT

A CMOS reference voltage generating circuit is described that produces a reference voltage by taking the difference between the gate-source voltages of two p-type and n-type CMOS transistors operating in the saturation region, one of the gate-source voltages being multiplied by a gain factor. Different circuits are described for situations where the n- or p-type transistors have the greater temperature dependence.

19 Claims, 6 Drawing Sheets

CM OS VOLTAGE REFERENCE

FIELD OF THE INVENTION

This invention relates to a voltage reference, and in particular to a voltage reference that can be implemented in CMOS technology and with good temperature stability.

BACKGROUND OF THE INVENTION

Being able to provide a voltage reference is important in many analog circuits such as linear regulators and data converters. The specifications of the voltage reference, including the temperature coefficient (TC), line regulation (LR) and noise all directly affect the performance of the circuit in which the voltage reference is incorporated. Common ways of providing a voltage reference include bipolar junction transistors, zener diodes, and JFET or depletion-mode NMOS transistors.

Difficulties arise, however, in implementing conventional voltage reference designs in CMOS technology. CMOS technology is popular in circuit design because of the relatively low fabrication costs and short turn-around periods involved. It is therefore strongly desirable to be able to implement a complete circuit, including any necessary voltage reference in CMOS technology.

PRIOR ART

In an attempt to implement a voltage reference in a CMOS environment it is known to use vertical bipolar junction transistors in p- or n-well and p- or n-MOS transistors operating in the weak inversion region to implement a bandgap reference voltage. An example of such a prior art proposal is shown in FIG. 1. In this design the voltage reference $V_{ref}=V_{be}$ (of Q3(1))+IR2. The base-emitter voltage of Q3(1) has a temperature dependency such that it decreases with temperature, while the current I generated by the current mirror has the property of increasing with temperature and thus IR2 also increases with temperature. Because the two components of the voltage reference have opposite temperature dependencies, by combining them a temperature independent voltage reference may be obtained. A disadvantage of such designs, however, is that trimming is required in the fabrication process and which substantially increases the fabrication costs.

U.S. Pat. No. 5,434534 (Lucas) describes a voltage reference circuit in which the threshold voltages of a p-type and of a n-type CMOS transistor are summed to provide a relatively temperature stable reference voltage. However this design is not completely satisfactory for a number of reasons. Firstly the temperature dependence of a p-type and an n-type CMOS transistor varies for different technologies and in general the dependence of p-type and n-type CMOS transistors are not the same. Thus summing the two voltages without any weighting cannot always provide a complete temperature compensated reference voltage. Furthermore, the circuit of Lucas sums the threshold voltages of p- and n-type CMOS transistors, which implies that a higher supply voltage is required.

SUMMARY OF THE INVENTION

According to the present invention there is provided a circuit for generating a reference voltage comprising a p-type CMOS transistor and an n-type CMOS transistor, said CMOS transistors being operated in the saturation region, and wherein the reference voltage is obtained from the difference between the gate-source voltage of the p- and n-type CMOS transistors with a gain factor greater than or less than 1 being applied to the gate-source voltage of either the p- or n-type CMOS transistor such that the reference voltage is given by the equation: $V_{ref}=k_1 \cdot V_{GSn}-k_2 \cdot |V_{GSp}|$ where either $k_1$ or $k_2$ is the gain factor and the other is unity.

It will be understood that depending on the materials used for the two CMOS transistors and their structure, either the p-type or the n-type transistor may have the greater temperature dependence. For applications where the p-type transistor has a greater temperature dependence the general equation may be implemented with either (1) $k_1>1$, $k_2=1$, or (2) $k_1=1$, $k_2<1$.

In a first embodiment of the invention (1) is implemented and the gain factor is applied to the gate-source voltage of the n-type transistor. In this embodiment the circuit may implement the equation:

$$V_{ref} = \left(1 + \frac{R_1}{R_2}\right) \cdot V_{GSn} - |V_{GSp}|$$

where $V_{ref}$ is the reference voltage, $V_{GSn}$ and $V_{GSp}$ are respectively the gate-source voltages of the n- and p-type CMOS transistors, and $R_1$ and $R_2$ are respectively first and second resistors connected respectively between the gate of the n-type transistor and the source of the p-type transistor ($R_1$), and between ground and the gate of the n-type transistor ($R_2$).

In this embodiment the values of $R_1$ and $R_2$ are set so as to minimise the temperature coefficient coefficient of the reference voltage circuit. In particular $R_1$ and $R_2$ are selected such that $$\frac{R_1}{R_2} = \frac{\beta_{vthp}}{\beta_{vthn}} - 1$$

where $\beta_{vthn}$ and $\beta_{vthp}$ are the temperature coefficients of the threshold voltages of the n- and p-type CMOS transistors respectively. Furthermore, the temperature coefficient of the circuit is minimised by adjusting the transistor size ratio of the CMOS transistors such that $$\frac{\left(\frac{W}{L}\right)_p}{\left(\frac{W}{L}\right)_n} = \frac{\frac{\mu_n(T_o)}{\mu_p(T_o)}\left(\frac{T_r}{T_o}\right)^{\beta_{\mu p}-\beta_{\mu n}}}{\left(1 + \frac{R_1}{R_2}\right)^2\left(\frac{1}{2} + \frac{\beta_{\mu n}}{2\beta_{\mu p}}\right)^2}$$

where (i)

$$\left(\frac{W}{L}\right)_p \text{ and } \left(\frac{W}{L}\right)_n$$

are the channel width to channel length ratio of p-type and n-type CMOS transistors.

(ii) $\mu_p$ ($T_o$) and $\mu_n$ ($T_o$) are the mobilities of p-type and n-type CMOS transistors at temperature $T_o$=0° C.

(iii) $\beta_{\mu p}$ and $\beta_{\mu n}$ are the mobility exponents of p-type and n-type CMOS transistors.

(iv) $T_r$ is the reference temperature which is set to have zero temperature coefficient.

In a second embodiment of the invention (2) is implemented and the gain factor is applied to the gate-source voltage of the p-type transistor. In this embodiment the circuit implements the equation $$V_{ref} = V_{GSn} - \left(\frac{R_2}{R_1 + R_2}\right) \cdot |V_{GSp}|$$

where $V_{ref}$ is the reference voltage, $V_{GSn}$ and $V_{GSp}$ are respectively the gate-source voltages of the n and p-type CMOS transistors, and $R_1$ and $R_2$ are respectively first and second resistors where R1 is connected between the source of the p-type transistor and the gate of the n-type transistor, and R2 is connected between the gate of the n-type transistor and the gate of the p-type transistor, and wherein the reference voltage is taken from the junction of the gate and the drain of the p-type transistor. As in the first embodiment of the invention, the temperature dependence of the circuit can be minimised by setting the resistor ratio, and the transistor size ratio.

For applications where the n-type transistor has a greater temperature dependence, the general equation may be implemented with either (3) $k_1<1$, $k_2=1$, or (4) $k_1=1$, $k_2>1$.

In a third embodiment of the invention (3) is implemented and the circuit implements the equation $$V_{ref} = \left(\frac{R_2}{R_1 + R_2}\right) \cdot V_{GSn} - |V_{GSp}|.$$

In a fourth embodiment of the invention (4) is implemented and the circuit implements the equation $$V_{ref} = V_{GSn} - \left(1 + \frac{R_1}{R_2}\right) \cdot |V_{GSp}|.$$

In both of these embodiments the temperature dependence of the circuit can again be minimised by adjusting the resistor ratio and the transistor size ratio.

In both of these embodiments the temperature dependence of the circuit can again be minimised by adjusting the resistor ratio and the transistor size ratio.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

The present invention is based on the concept of taking the difference between the gate-source voltages of an n-type and a p-type MOSFET operating in the saturation region. Both n- and p-type MOSFETs have a temperature dependence that is similar in that the gate-source voltage decreases with increasing temperature. However the temperature coefficient may differ from one MOSFET to another and so rather than taking the simple difference between the two gate-source voltages, a gain factor is applied to one or the other of the two gate-source voltages in order to compensate for this difference in temperature coefficient. In this way a temperature independent voltage reference can be obtained.

Four embodiments of the invention will now be described. As will be come clear all the embodiments implement the general equation: $V_{ref}=k_1 \cdot V_{GSn}-k_2 \cdot |V_{GSp}|$. In general terms the temperature dependence of the p-type or the n-type CMOS transistors will be greater than the other. When the temperature dependence of the p-type is stronger, the general equation can be implemented such that either (1) $k_1>1$, $k_2=1$, or (2) $k_1=1$, $k_2<1$. Where the temperature dependence of the n-type CMOS transistor is greater than the p-type, then the general equation can be implemented by two further possibilities such that either (3) $k_1<1$, $k_2=1$, or (4) $k_1=1$, $k_2>1$.

Figure 1:
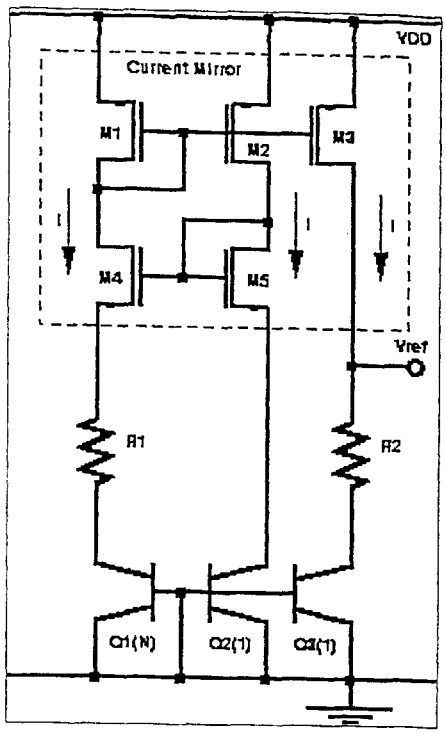
Fig. 1 Prior Art
FIG. 1 is a circuit diagram of a voltage reference according to the prior art.
Figure 2:
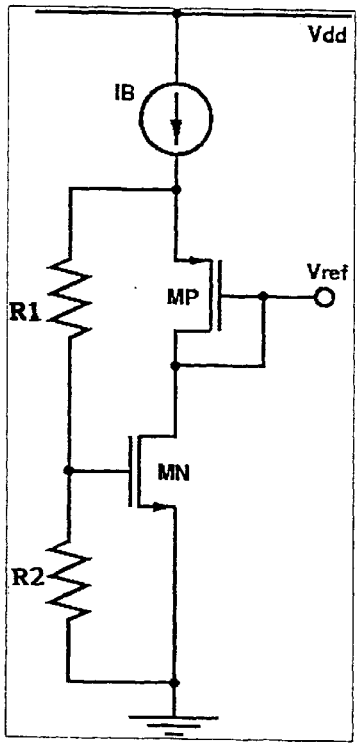
FIG. 2 is a circuit diagram of a voltage reference according to a first embodiment of the present invention.

A first embodiment of the invention is illustrated by the circuit of FIG. 2. The circuit of this embodiment implements the equation $V_{ref}=k_1 \cdot V_{GSn}-k_2 \cdot |V_{GSp}|$ with $k_1>1$, $k_2=1$. In this embodiment:

$$V_{ref} = \left(1 + \frac{R_1}{R_2}\right) \cdot V_{GSn} - |V_{GSp}|$$

In this embodiment the gain factor is applied to the gate-source voltage of the n-type MOSFET (MN) and since this gain factor is always larger than 1 this embodiment is appropriate for circuits where the n- and p-type MOSFETS are such that the p-type MOSFET has a greater temperature coefficient than the n-type.

Figure 3:
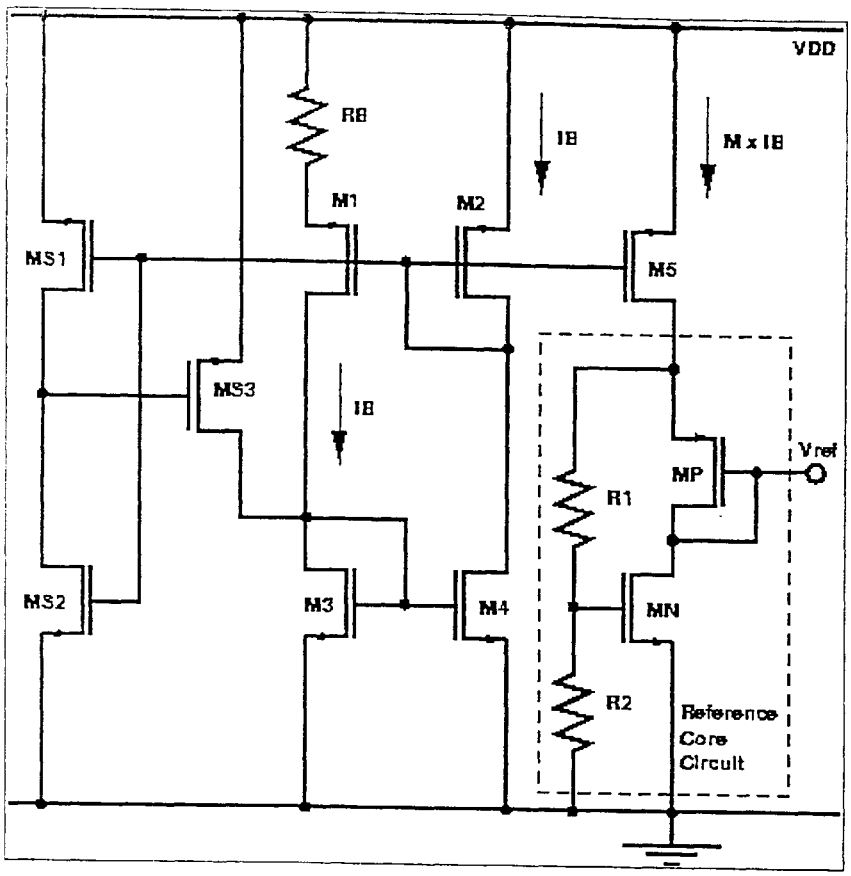
FIG. 3 is a circuit diagram showing the circuit of FIG. 2 in the context of a circuit supplying a bias current.

As can be seen from FIG. 2 the CMOS voltage reference requires a bias current IB, and FIG. 3 shows how the CMOS voltage reference circuit may be applied in a circuit that is adapted to provide such a bias current. The part of the circuit within broken lines corresponds to the voltage reference circuit of FIG. 2, while the remainder of the circuit is a conventional design that is adapted to feed a bias current into the voltage reference. It will be understood, however that any conventional source of a bias current may be employed. In the circuit of FIG. 3 a bias current of M×IB is created.

In this embodiment the temperature dependence of the voltage reference is given by the equation:

$$\frac{\partial V_{ref}}{\partial T} = \left(1 + \frac{R_1}{R_2}\right)\frac{\partial V_{GSn}}{\partial T} - \frac{\partial |V_{GSp}|}{\partial T} = \left[-\left(1 + \frac{R_1}{R_2}\right)\beta_{vthn} + \beta_{vthp}\right] + \frac{\beta_{\mu p}}{T_o}\sqrt{\frac{2MI_B(T_o)}{\mu_p(T_o)C_{ox}\left(\frac{W}{L}\right)_p}} \times$$

-continued $$\left[\left(1+\frac{R_1}{R_2}\right)\left(\frac{1}{2}+\frac{\beta_{\mu n}}{2\beta_{\mu p}}\right)\sqrt{\frac{\mu_p(T_o)\left(\frac{W}{L}\right)_p}{\mu_n(T_o)\left(\frac{W}{L}\right)_n}}\left(\frac{T}{T_o}\right)^{\frac{\beta_{\mu p}+\beta_{\mu n}-2}{2}}-\left(\frac{T}{T_o}\right)^{\beta_{\mu p}-1}\right]$$

where (i) $\beta_{vthp}$ and $\beta_{vthn}$ are the temperature coefficients of the threshold voltages of p-type and n-type CMOS transistors.

(ii)

$$\left(\frac{W}{L}\right)_p \text{ and } \left(\frac{W}{L}\right)_n$$

and are the channel width to channel length ratio of p-type and n-type CMOS transistors.

(iii) $\mu_p$ ($T_o$) and $\mu_n$ ($T_o$) are the mobilities of p-type and n-type CMOS transistors at temperature $T_o$=0° C.

(vi) $\beta_{\mu p}$ and $\beta_{\mu n}$ are the mobility exponents of p-type and n-type CMOS transistors.

(v) $C_{ox}$ is the capacitance of gate oxide of a CMOS transistor.

(vi) $I_B(T_o)$ is the bias current at $T_o$=0° C., and (vii) M is a multiple factor of the current mirror.

It will thus be seen that the temperature dependence depends on a linear term and a higher-order term. The linear term can be set by appropriately adjusting the resistor ratio such that:

$$\frac{R_1}{R_2}=\frac{\beta_{vthp}}{\beta_{vthn}}-1$$

while the higher order can be set to zero at room temperature by appropriately adjusting the transistor size ratio such that $$\frac{\left(\frac{W}{L}\right)_p}{\left(\frac{W}{L}\right)_n}=\frac{\frac{\mu_n(T_o)}{\mu_p(T_o)}\left(\frac{T_r}{T_o}\right)^{\beta_{\mu p}-\beta_{\mu n}}}{\left(1+\frac{R_1}{R_2}\right)^2\left(\frac{1}{2}+\frac{\beta_{\mu n}}{2\beta_{\mu p}}\right)^2}$$

where (i)

$$\left(\frac{W}{L}\right)_p \text{ and } \left(\frac{W}{L}\right)_n$$

are the channel width to channel length ratio of p-type and n-type CMOS transistors.

(ii) $\mu_p(T_o)$ and $\mu_n(T_o)$ are the mobilities of p-type and n-type CMOS transistors at temperature $T_o$=0° C.

(iii) $\beta_{\mu p}$ and $\beta_{\mu n}$ are the mobility exponents of p-type and n-type CMOS transistors.

The embodiment of FIG. 3 has been implemented by way of an example in an AMS 0.6 $\mu$m CMOS process with an occupied chip area of 0.051 mm$^2$ which is significantly smaller than a conventional bandgap reference. The minimum supply voltage is 1.4 V and this can be reduced further if lower threshold devices are used. The supply current is 7 $\mu$A at 100° C.

Figure 4:
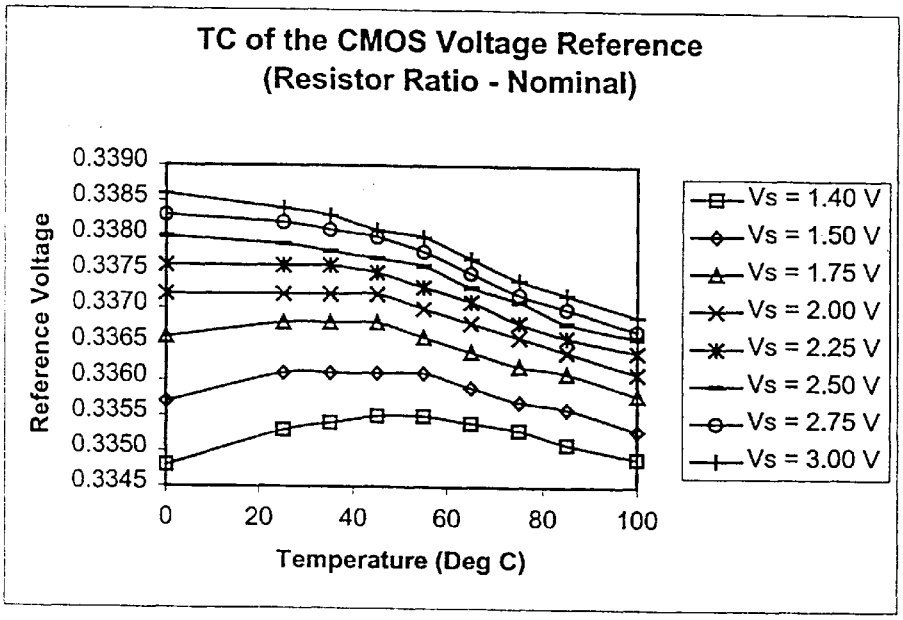
FIG. 4 is a plot illustrating the temperature coefficient (TC) of the embodiment of FIGS. 2 & 3.
Figure 5:
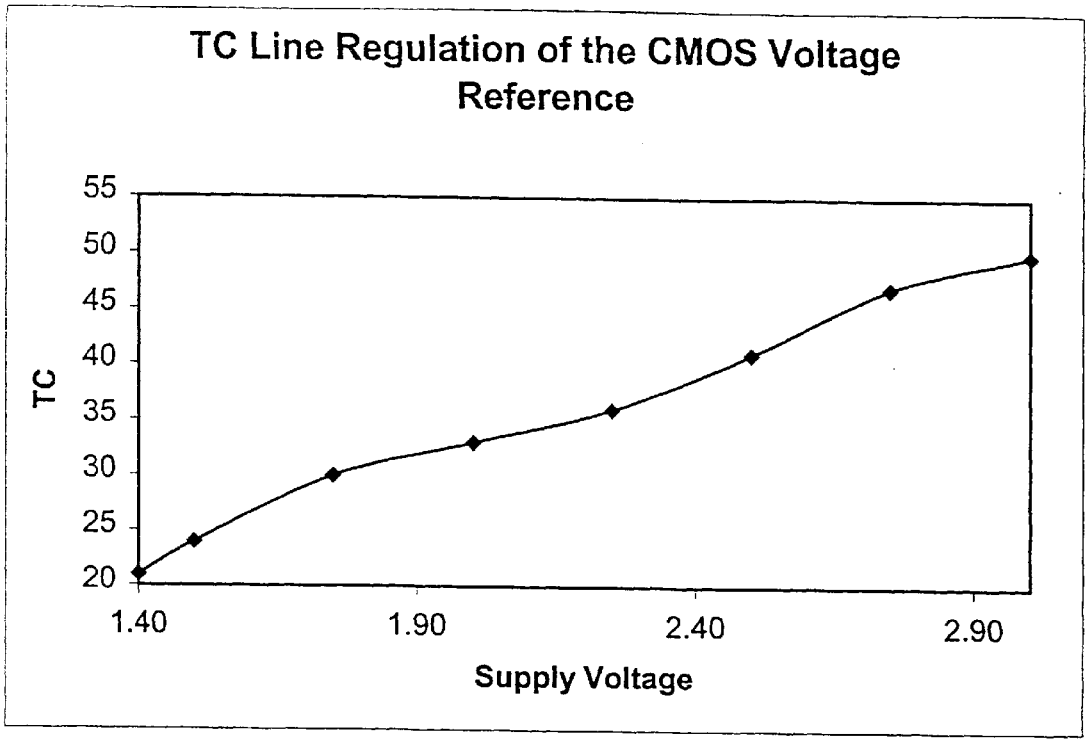
FIG. 5 is a plot illustrating the TC line regulation of the embodiment of FIGS. 2 & 3, FIGS. 6 to 8 show the effect on the TC of the voltage reference of the first embodiment with variations in the resistor ratio.

FIG. 4 shows the reference voltage as a function of temperature at various supply voltages in order that the temperature coefficient can be determined, while FIG. 5 plots the temperature coefficient (at room temperature) as a function of the supply voltage. It will be seen from these figures that a TC of 21 ppm/° C. from 0 to 100°C. is obtained at a supply voltage of 1.4V, while the TC changes from 21 to 50 ppm/°C. when the supply voltage increases from 1.4 to 3V. This increase in TC is due to current matching difficulties of M3 and M4 in the bias circuit with a higher supply voltage. A pre-regulated circuit can be added to provide a more stable supply to the voltage reference.

Figure 6:
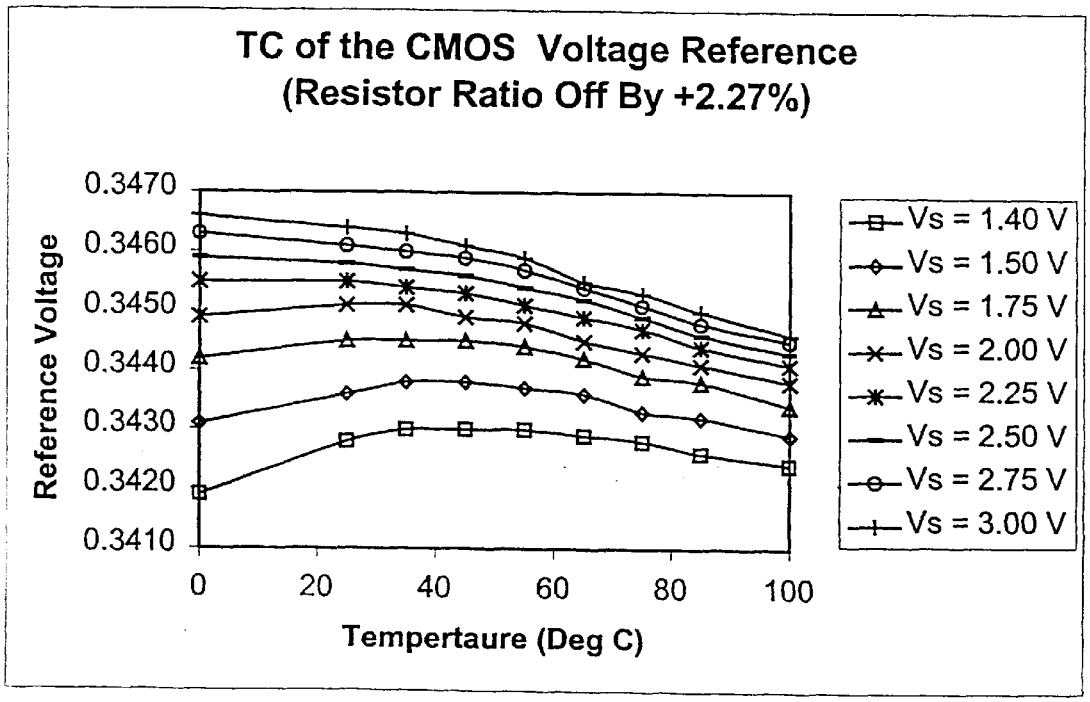
Figure 7:
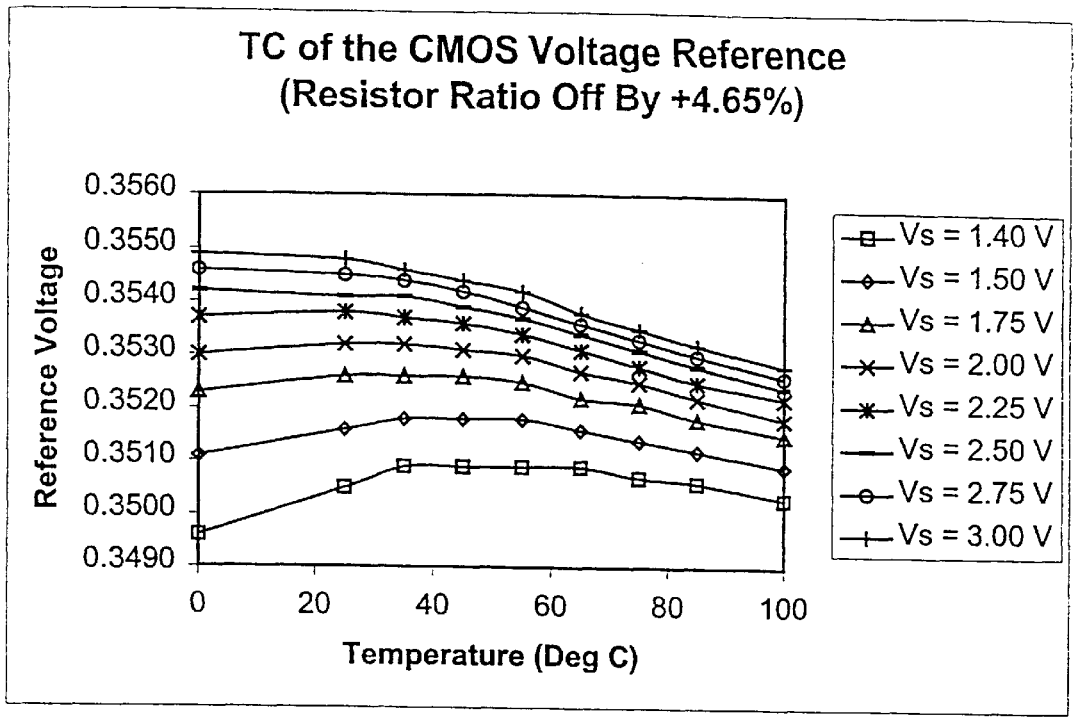
Figure 8:
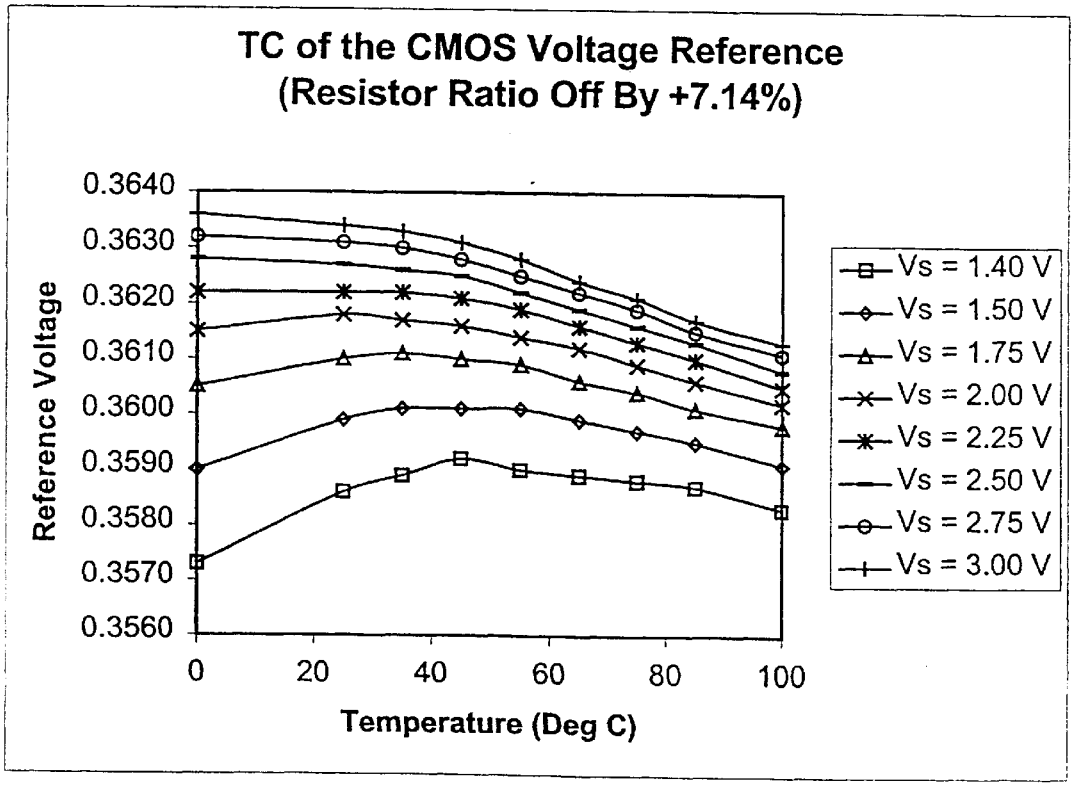

The sensitivity of the voltage reference to variations in the resistor ratio can be tested by introducing an intentional variation into the ratio. The results are shown in FIGS. 6 to 8 which show respectively ratio variations of 2.27%, 4.65% and 7.14%. With a large variation in the resistor ration there is a larger increase in the TC because a complete cancellation of the temperature dependence of the threshold voltages cannot be achieved. In practice, however, variations in the resistor ratio as large as 7.14% seldom occur.

Figure 9:
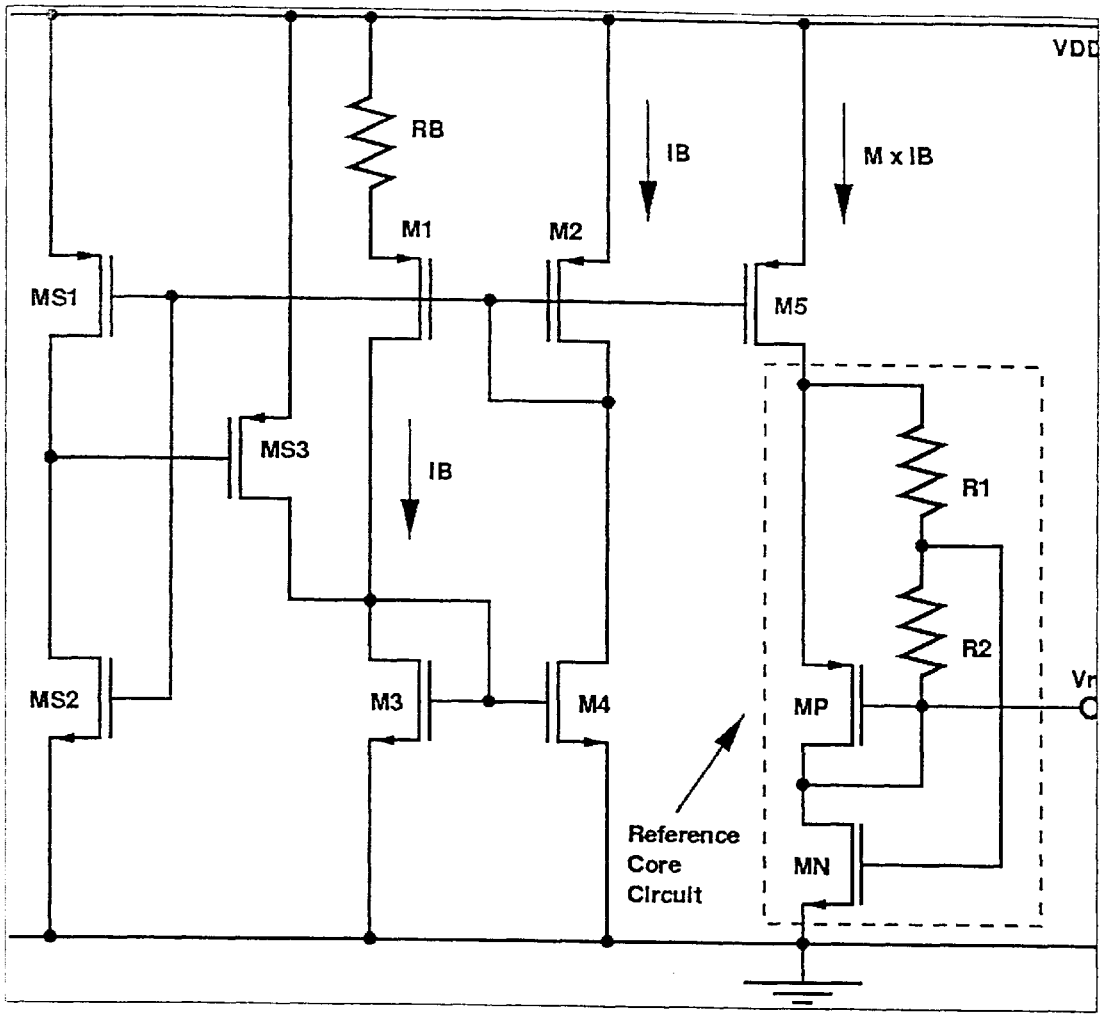
FIG. 9 is a circuit diagram showing a second embodiment of the present invention.

FIG. 9 shows a second embodiment of the invention in which the reference voltage circuit is shown in the area within broken lines, the remainder of the circuit representing a current supply circuit. This circuit is also suitable for a situation in which the temperature dependence of the p-type transistor is greater than that of the n-type transistor. IN particular the circuit of this embodiment implements the general equation $V_{ref}=k_1\cdot V_{GSn}-k_2\cdot|V_{GSp}|$ with $k_1=1$, $k_2<1$. In particular, in this embodiment the voltage reference is given by the equation $$V_{ref}=V_{GSn}-\left(\frac{R_2}{R_1+R_2}\right)\cdot|V_{GSp}|$$

In this embodiment therefore the gain factor is applied to the gate-source voltage of the p-type transistor, however in contrast to the embodiment of FIGS. 2 and 3 the gain factor is always smaller than 1.

As with the first embodiment, the temperature coefficient of the linear term can be minimised by setting the resistor ratio with the same equation as in the first embodiment, while the higher order term can be minimised by setting the transistor size ratio as in the first embodiment. It is important to note that in both embodiments the most important parameter in minimising the temperature coefficient is setting the resistor ratio, with the transistor ratio being a refinement.

In both embodiments of the invention a relatively temperature stable reference voltage can be obtained that may readily be implemented in CMOS technology and which does not require extensive trimming. The voltage reference can subsequently be increased or decreased as required by converter circuitry downstream of the reference voltage generating circuit of the present invention.

Two further embodiments will now be described that are suitable for applications where the n-type CMOS transistor has a greater temperature dependence than the p-type transistor.

Figure 10:
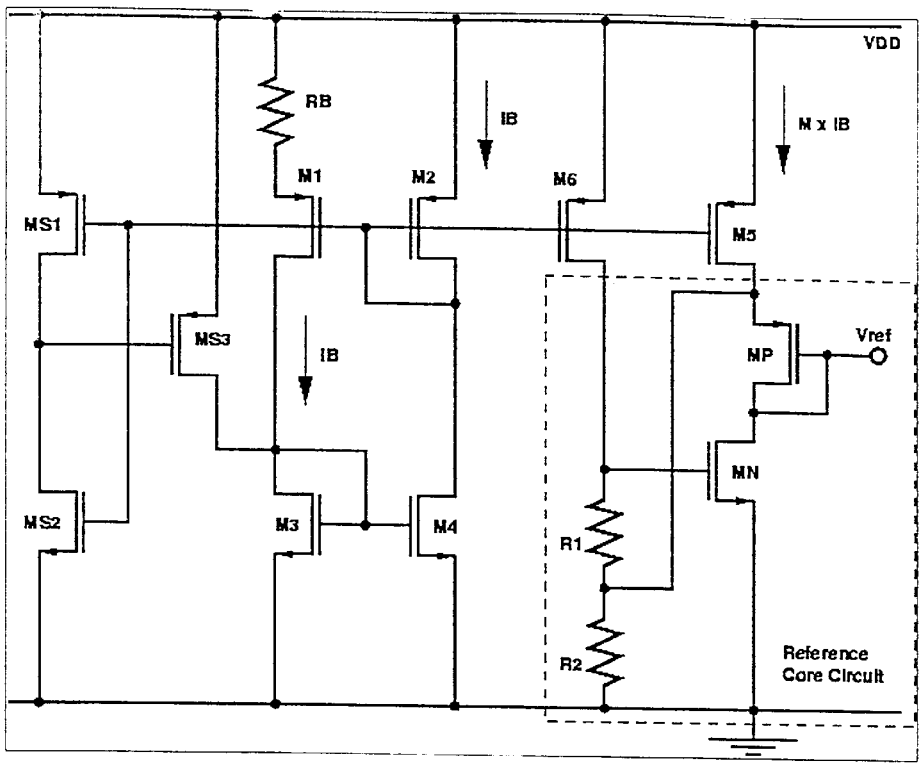
FIG. 10 is a circuit diagram showing a third embodiment of the present invention.

In the embodiment of FIG. 10 the general equation $V_{ref}=k_1 \cdot V_{GSn}-k_2 \cdot |V_{GSp}|$ is implemented with $k_1<1$, $k_2=1$. In particular in the embodiment of FIG. 10:

$$V_{ref} = \left(\frac{R_2}{R_1 + R_2}\right) \cdot V_{GSn} - |V_{GSp}|.$$

Figure 11:
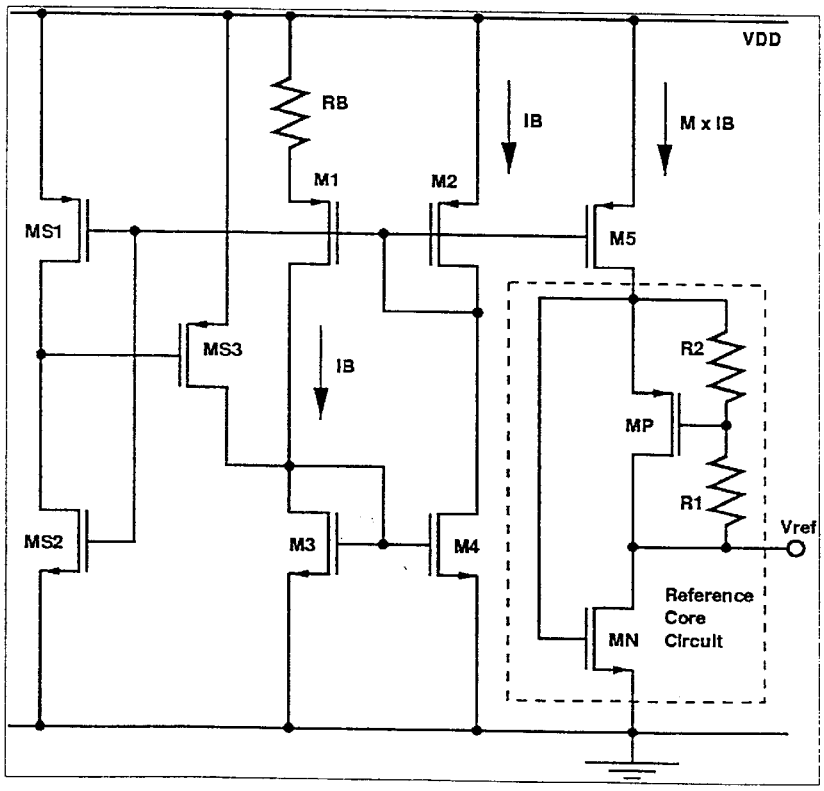
FIG. 11 is a circuit diagram showing a fourth embodiment of the present invention.

In the embodiment of FIG. 11 the general equation $V_{ref}=k_1 \cdot V_{GSn}-k_2 \cdot |V_{GSp}|$ is implemented with) $k_1=1$, $k_2>1$. In particular in the embodiment of FIG. 11:

$$V_{ref} = V_{GSn} - \left(1 + \frac{R_1}{R_2}\right) \cdot |V_{GSp}|.$$

For the embodiments of both FIGS. 10 and 11, the linear term of the temperature dependence of the reference voltage may be eliminated by appropriately setting the resistor ratio such that $$\frac{R_1}{R_2} = \frac{\beta_{vthn}}{\beta_{vthp}} - 1$$

where $\beta_{vthn}$ and $\beta_{vthp}$ are the temperature coefficients of the threshold voltages of n- and p-type CMOS transistor, respectively.

For the embodiments of both FIGS. 10 and 11 the non-linear term of the temperature dependence of the reference voltage is cancelled by the transistor ratio, which is given by $$\frac{\left(\frac{W}{L}\right)_p}{\left(\frac{W}{L}\right)_n} = \frac{\frac{\mu_n(T_o)}{\mu_p(T_o)}\left(1 + \frac{R_1}{R_2}\right)^2 \left(\frac{T_r}{T_o}\right)^{\beta_{\mu p} - \beta_{\mu n}}}{\left(\frac{1}{2} + \frac{\beta_{\mu n}}{2\beta_{\mu p}}\right)^2}$$

(i)

$$\left(\frac{W}{L}\right)_p \text{ and } \left(\frac{W}{L}\right)_n$$

are the channel width to channel length ratio of p-type and n-type CMOS transistors, (ii) $\mu_p(T_o)$ and $\mu_n(T_o)$ are the mobilities of p-type and n-type CMOS transistors at temperature $T_o$=0° C., (iii) $\beta_{\mu p}$ and $\beta_{\mu n}$ are the mobility exponents of p-type and n-type CMOS transistors, and (iv) $T_r$ is the reference temperature, which is set to have zero temperature coefficient.

What is claimed is:

1. A circuit for generating a reference voltage comprising a p-type CMOS transistor and an n-type CMOS transistor, said CMOS transistors being operated in the saturation region, and wherein the reference voltage is obtained from the difference between the gate-source voltage of the p- and n-type CMOS transistors with a gain factor greater than or less than 1 being applied to the gate-source voltage of either the p- or n-type CMOS transistor such that the reference voltage is given by the equation: $V_{ref}=k_1 \cdot V_{GSn}-k_2 \cdot |V_{GSp}|$ where either $k_1$ or $k_2$ is the gain factor and the other is unity.

2. A reference voltage circuit as claimed in claim 1 wherein the temperature dependence of the p-type transistor is greater than the temperature dependence of the n-type transistor and either (1) $k_1>1$, $k_2=1$, or (2) $k_1=1$, $k_2<1$.

3. A reference voltage circuit as claimed in claim 2 wherein the circuit implements the equation:

$$V_{ref} = \left(1 + \frac{R_1}{R_2}\right) \cdot V_{GSn} - |V_{GSp}|$$

where $V_{ref}$ is the reference voltage, $V_{GSn}$ and $V_{GSp}$ are respectively the gate-source voltages of the n- and p-type CMOS transistors, and $R_1$ and $R_2$ are respectively first and second resistors connected respectively between the gate of the n-type transistor and the source of the p-type transistor ($R_1$), and between ground the gate of the n-type transistor ($R_2$).

4. A reference voltage circuit as claimed in claim 3 wherein the values of $R_1$ and $R_2$ are set so as to minimise the temperature coefficient of the reference voltage circuit.

5. A reference voltage circuit as claimed in claim 4 wherein $R_1$ and $R_2$ are selected such that $$\frac{R_1}{R_2} = \frac{\beta_{vthp}}{\beta_{vthn}} - 1$$

where $\beta_{vthn}$ and $\beta_{vthp}$ are the temperature coefficients of the threshold voltages of the n- and p-type CMOS transistors respectively.

6. A reference voltage circuit as claimed in claim 3 wherein the temperature coefficient of the circuit is minimised by adjusting the transistor size ratio of the CMOS transistors such that $$\frac{\left(\frac{W}{L}\right)_p}{\left(\frac{W}{L}\right)_n} = \frac{\frac{\mu_n(T_o)}{\mu_p(T_o)}\left(\frac{T_r}{T_o}\right)^{\beta_{\mu p} - \beta_{\mu n}}}{\left(1 + \frac{R_1}{R_2}\right)^2 \left(\frac{1}{2} + \frac{\beta_{\mu n}}{2\beta_{\mu p}}\right)^2}$$

where (i)

$$\left(\frac{W}{L}\right)_p \text{ and } \left(\frac{W}{L}\right)_n$$

are the channel width to channel length ratio of p-type and n-type CMOS transistors.

(ii) $\mu_p(T_o)$ and $\mu_n(T_o)$ are the mobilities of p-type and n-type CMOS transistors at temperature $T_o$=0° C.

(iii) $\beta_{\mu p}$ and $\beta_{\mu n}$ are the mobility exponents of p-type and n-type CMOS transistors, (iv) $T_r$ is the reference temperature which is set to have zero temperature coefficient.

7. A reference voltage circuit as claimed in claim 2 wherein the circuit implements the equation $$V_{ref} = V_{GSn} - \left(\frac{R_2}{R_1 + R_2}\right) \cdot |V_{GSp}|$$

where $V_{ref}$ is the reference voltage, $V_{GSn}$ and $V_{GSp}$ are respectively the gate-source voltages of the n- and p-type CMOS transistors, and $R_1$ and $R_2$ are respectively first and second resistors where $R_1$ is connected between the source of the p-type transistor and the gate of the n-type transistor, and $R_2$ is connected between the gate of the n-type transistor and the gate of the p-type transistor, and wherein the reference voltage is taken from the junction of the gate and the drain of the p-type transistor.

8. A reference voltage circuit as claimed in claim 7 wherein the values of $R_1$ and $R_2$ are set so as to minimise the temperature coefficient of the reference voltage circuit.

9. A reference voltage circuit as claimed in claim 8 wherein $R_1$ and $R_2$ are selected such that $$\frac{R_1}{R_2} = \frac{\beta_{vthp}}{\beta_{vthn}} - 1$$

where $\beta_{vthn}$ and $\beta_{vthp}$ are the temperature coefficients of the threshold voltages of the n- and p-type CMOS transistors respectively.

10. A reference voltage circuit as claimed in claim 7 wherein the temperature coefficient of the circuit is minimised by adjusting the transistor size ratio of the CMOS transistors such that $$\frac{\left(\frac{W}{L}\right)_p}{\left(\frac{W}{L}\right)_n} = \frac{\frac{\mu_n(T_o)}{\mu_p(T_o)}\left(\frac{T_r}{T_o}\right)^{\beta_{\mu p}-\beta_{\mu n}}}{\left(1+\frac{R_1}{R_2}\right)^2\left(\frac{1}{2}+\frac{\beta_{\mu n}}{2\beta_{\mu p}}\right)^2}$$

where (i)

$$\left(\frac{W}{L}\right)_p \text{ and } \left(\frac{W}{L}\right)_n$$

are the channel width to channel length ratio of p-type and n-type CMOS transistors.

(ii) $\mu_p(T_o)$ and $\mu_n(T_o)$ are the mobilities of p-type and n-type CMOS transistors at temperature $T_o$=0° C.

(v) $\beta_{\mu p}$ and $\beta_{\mu n}$ are the mobility exponents of p-type and n-type CMOS transistors, (vi) $T_r$ is the reference temperature which is set to have zero temperature coefficient.

11. A reference voltage circuit as claimed in claim 1 wherein the temperature dependence of the n-type transistor is greater than the temperature dependence of the p-type transistor and either (1) $k_1<1$, $k_2=1$, or (2) $k_1=1$, $k_2>1$.

12. A reference voltage circuit as claimed in claim 11 wherein the circuit implements the equation:

$$V_{ref} = \left(\frac{R_2}{R_1+R_2}\right)\cdot V_{GSn} - |V_{GSp}|.$$

13. A reference voltage circuit as claimed in claim 12 wherein the values of $R_1$ and $R_2$ are set so as to minimise the temperature coefficient of the reference voltage circuit.

14. A reference voltage circuit as claimed in claim 13 wherein the temperature coefficient of the circuit is minimised by adjusting the resistor ratio such that $$\frac{R_1}{R_2} = \frac{\beta_{vthn}}{\beta_{vthp}} - 1$$

where $\beta_{vthn}$ and $\beta_{vthp}$ are the temperature coefficients of the threshold voltages of n- and p-type CMOS transistors, respectively.

15. A reference voltage circuit as claimed in claim 12 wherein the temperature coefficient of the circuit is minimised by adjusting the transistor size ratio of the CMOS transistors such that $$\frac{\left(\frac{W}{L}\right)_p}{\left(\frac{W}{L}\right)_n} = \frac{\frac{\mu_n(T_o)}{\mu_p(T_o)}\left(1+\frac{R_1}{R_2}\right)^2\left(\frac{T_r}{T_o}\right)^{\beta_{\mu p}-\beta_{\mu n}}}{\left(\frac{1}{2}+\frac{\beta_{\mu n}}{2\beta_{\mu p}}\right)^2}$$

where (i)

$$\left(\frac{W}{L}\right)_p \text{ and } \left(\frac{W}{L}\right)_n$$

are the channel width to channel length ratio of p-type and n-type CMOS transistors, (ii) $\mu_p(T_o)$ and $\mu_n(T_o)$ are the mobilities of p-type and n-type CMOS transistors at temperature $T_o$=0° C., (iii) $\beta_{\mu p}$ and $\beta_{\mu n}$ are the mobility exponents of p-type and n-type CMOS transistors, and (iv) $T_r$ is the reference temperature, which is set to have zero temperature coefficient.

16. A voltage reference circuit as claimed in claim 11 wherein said circuit implements the equation $$V_{ref} = V_{GSn} - \left(1+\frac{R_1}{R_2}\right)\cdot|V_{GSp}|.$$

17. A reference voltage circuit as claimed in claim 16 wherein the values of $R_1$ and $R_2$ are set so as to minimise the temperature coefficient of the reference voltage circuit.

18. A reference voltage circuit as claimed in claim 17 wherein the temperature coefficient of the circuit is minimised by adjusting the resistor ratio such that $$\frac{R_1}{R_2} = \frac{\beta_{vthn}}{\beta_{vthp}} - 1$$

where $\beta_{vthn}$ and $\beta_{vthp}$ are the temperature coefficients of the threshold voltages of n- and p-type CMOS transistors, respectively.

19. A reference voltage circuit as claimed in claim 16 wherein the temperature coefficient of the circuit is minimised by adjusting the transistor size ratio of the CMOS transistors such that $$\frac{\left(\frac{W}{L}\right)_p}{\left(\frac{W}{L}\right)_n} = \frac{\frac{\mu_n(T_o)}{\mu_p(T_o)}\left(1+\frac{R_1}{R_2}\right)^2\left(\frac{T_r}{T_o}\right)^{\beta_{\mu p}-\beta_{\mu n}}}{\left(\frac{1}{2}+\frac{\beta_{\mu n}}{2\beta_{\mu p}}\right)^2}$$

where (i)

$$\left(\frac{W}{L}\right)_p \text{ and } \left(\frac{W}{L}\right)_n$$

are the channel width to channel length ratio of p-type and n-type CMOS transistors, (ii) $\mu_p(T_o)$ and $\mu_n(T_o)$ are the mobilities of p-type and n-type CMOS transistors at temperature $T_o$=0° C., (v) $\beta_{\mu p}$ and $\beta_{\mu n}$ are the mobility exponents of p-type and n-type CMOS transistors, and (vi) $T_r$ is the reference temperature, which is set to have zero temperature coefficient.

* * * * *